United States Patent [19]

Tanaka et al.

[11] Patent Number: 4,498,569

[45] Date of Patent: Feb. 12, 1985

[54] COMMODITY RACK FOR AUTOMATIC VENDING MACHINES

[75] Inventors: Nobuyasu Tanaka, Yokkaichi; Mitunari Ohashi, Kuwana; Shohzoh Iwamoto, Yokkaichi, all of Japan

[73] Assignee: Fuji Electric Co., Ltd., Tokyo, Japan

[21] Appl. No.: 398,196

[22] Filed: Jul. 14, 1982

[30] Foreign Application Priority Data

Jul. 14, 1981 [JP] Japan ..... 56-109609
Aug. 25, 1981 [JP] Japan ..... 56-125323[U]

[51] Int. Cl.[3] ..... G07F 11/34

[52] U.S. Cl. ..... 193/27; 221/281; 221/312 R; 312/45

[58] Field of Search ..... 221/266, 281, 295, 312 R; 211/49 D; 312/45, 72; 193/27, 28

[56] References Cited

U.S. PATENT DOCUMENTS 1,088,980 3/1914 Goble ..... 193/27
1,981,272 11/1934 Kuhn et al. ..... 193/27 X
1,985,739 12/1934 Murray ..... 193/27
2,252,493 8/1941 Dennis ..... 221/281 X
3,379,294 4/1968 Van Liew ..... 193/27 X
3,467,275 9/1969 Vaughan et al. ..... 221/295 X
3,508,669 4/1970 Cook ..... 193/27 X

FOREIGN PATENT DOCUMENTS 1054795 2/1954 France ..... 221/312 R

*Primary Examiner*—F. J. Bartuska
*Attorney, Agent, or Firm*—Bruce L. Birchard

[57] ABSTRACT

By providing planar, auxiliary rail segments, each of which, in the stand-by state, protrudes into the commodity passageway with an upwardly-inclined posture and is pivotable to a downwardly-inclined posture upon impact from an article to be stored, the kinetic energy of the article as it proceeds down the rack is dissipated in changing the position of the auxiliary rail segment and damage to the article to be stored and any already-stored articles which is may encounter is prevented. The auxiliary rail segment may be spring biased and/or loaded to produce the desired amount of energy dissipation at each rail segment.

2 Claims, 28 Drawing Figures

COMMODITY RACK FOR AUTOMATIC VENDING MACHINES

RELATED CO-PENDING APPLICATION

This application is directed to subject matter related to that in U.S. patent application Ser. No. 323,385 filed Nov. 20, 1981 by Hiroshi Tominaga and assigned to the same assignee as this application.

BACKGROUND OF THE INVENTION

1. Field of the Invention

This invention relates to automatic vending machines and more particularly to serpentine commodity racks for such machines.

2. Prior Art

The general construction of the conventional serpentine type commodity rack is outlined hereinafter with reference to FIG. 1 of the accompanying drawings. In FIG. 1, reference numeral 1 designates left and right side plates for the rack 200, between which a plurality of curved rail segments 2 are installed in vertical combination one after the other, thereby constituting two rows of guide rails 3 and 4 one at the front side 202 and one at the back side 204. Between the guide rails 3, 4 there is defined the serpentine passageway 5 for the articles which extends in the vertical direction. The passageway 5 has openings at its top and bottom ends facing frontwards of the commodity rack, the top opening being an inlet 6 for the articles and the bottom opening being an outlet 7 for removing dispensed articles. Further, a vending mechanism 8 for removing and checking the articles, one at a time, in accordance with instructions for vending is installed at the outlet 7 for dispensing the purchased goods at the bottom end of the passgeway 5. Numeral 9 designates a fixed pin for each of the curved rail segments 2, and numeral 10 denotes a top tray provided at inlet opening 6 on the top end of passageway 5.

In for foregoing commodity rack 200, the steps for receiving the articles for vending are as follows. Articles 11 in cylindrical containers are supplied through the top inlet opening 6 with their longitudinal axes horizontal and roll down the commodity rack 200, one-by-one. Accordingly, a cylindrical article 11 rolls on the top tray 10 and at the end of it drops into passageway 5 in the direction indicated by arrow A, while hitting the concaved surface of each of the guide rails 3, 4. The subsequent articles follow the same course and sequentially drop on the articles already accumulated at the bottom end of passageway 5. All of the supplied articles are accommodated in the passageway in a queue. When instructions for vending are imparted to the vending mechanism 8, that mechanism is actuated to release the thus stored articles, one by one, starting with the lowest one, as is already well known.

Recently, the articles sold by automatic vending machines have become diversified, the containers for them ranging from metal cans to glass bottles. These various types of containers also have various contents for example carbonated beverages and beer.

As indicated, the afore-described serpentine type of rack has a tortuous passageway 5 and the vending articles supplied at the inlet 6 roll down the tortuous passageway 5 along a zig-zag path. The force of impact produced when they drop on one another can thus be relatively slight, and their containers can withstand such shock. Even so, the dropping speed increases as an article rolls freely downward into the rack from the inlet 6 and acquires significant momentum just before it reaches its final stoppage position. On account of this, when articles or goods in fragile containers, such as glass bottles, are thrown into the passageway 5, the containers are frequently broken by the impact force experienced on landing at the bottom of the commodity rack, or from collisions with other bottles. Even if the glass bottles do not in fact break, the carbonated content such as beer and carbonated beverages exhibits abnormal foaming when the bottle cap is removed due to the shock of the collison. In addition, articles with barrel-shaped containers and others which are relatively unstable in posture tend to readily lose their rolling pose even upon very slight contact with the structural element defining the passageway, as their rolling speeds increase. As a consequence, containers smaller than the passageway, in particular, tend to lose their posture during the roll-down movement in and along the passageway. There is, therefore, a great possibility that they will become lodged on their way down the passageway, thereby causing the path to clog with articles.

From this point of view, it is desirable in the serpentine type of commodity rack that the dropping speed of the articles be restricted as far as possible to thus diminish the impact load resulting from the fall of the articles, and to accurately maintain the rolling posture of the articles during their downward rolling movement through the passageway. Hence, while it may be desirable to construct the passageway in the commodity rack such that its inclination is only slight, such construction will increase the depth of the rack. The consequence is that the outer casing of the automatic vending machine also increases in depth, thus taking up more space at the shop front or wherever the automatic vending machine is to be installed. Such space is rarely available.

In view of the afore-described problems, it is a primary object of the present invention to eliminate the above-mentioned defects inherent in the serpentine type commodity racks of conventional automatic vending machines.

This object is achieved by a commodity rack as set forth in claim 1 with further advantageous features being characterized in the dependent claims.

SUMMARY OF THE INVENTION

The present invention provides pivotally supported, planar, auxiliary rail segments each of which, in the stand-by state for receiving goods or articles in the commodity rack, is so positioned that it protrudes into the commodity passageway with an upwardly inclined posture, and, at the time an article reaches any such auxiliary rail segment, the rail segment will reduce the roll-down speed of the article, and the upwardly slanted posture of the auxiliary rail segment will be changed to a downwardly slanted posture, in an action similar to the action of a see-saw, due to the dead weight of the supplied article upon the segment. The article then moves further towards the exit from the passageway. The "see-saw" action of the segments dissipates the kinetic energy of the articles.

BRIEF DESCRIPTION OF THE DRAWINGS

Ways of carrying out the invention are described in detail hereinafter with reference to the accompanying drawings which illustrate only specific embodiments and in which.

DETAILED DESCRIPTION OF THE PREFERRED EMBODIMENT

Figure 1:
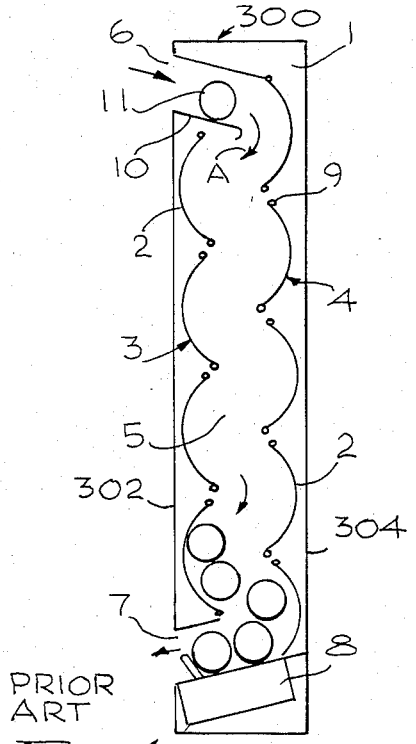
FIG. 1 is a side view of a conventional serpentine-type commodity rack.

FIG. 1 having been discussed under Prior Art, we will turn to the remaining figures.

Figure 2A:
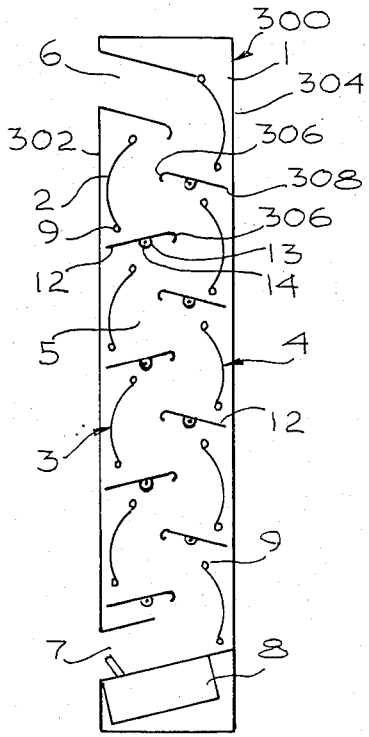
FIGS. 2A and 2B are schematic side views of a basic embodiment of the invention, FIG. 2A showing a state in which no articles have been supplied to the rack, and FIG. 2B a state in which articles have been supplied thereto.
Figure 2B:
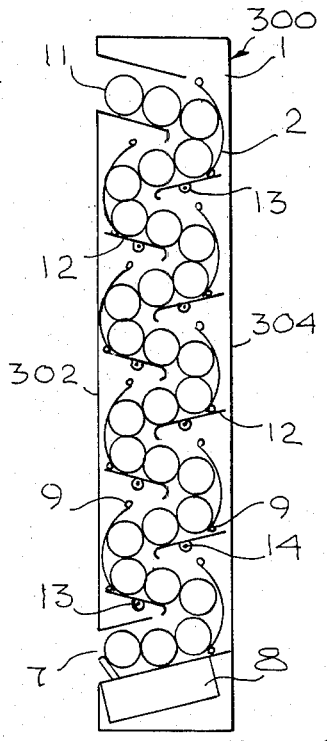

Referring first to FIGS. 2A and 2B showing the basic structure of a first embodiment of the commodity rack according to the present invention, the guide rails 3, 4 are formed by the combination of a plurality of curved rail segments 2 (similar to conventional ones) and a plurality of "see-saw" type auxiliary rail segments 12, each being positioned beneath a respective one of the curved rail segments 2. Each "see-saw" type rail segment 12 is supported by fixing its hinge arm 13 on a rotational pin 14 so as to permit pivotal motion about this pin 14 as the pivotal shaft. In addition, each auxiliary rail segment 12 is so constructed that, in its stand-by state, as shown in FIG. 2A, in which it is free to have an article 11 loaded onto it, its length between the pivotal shaft 14, and the forward end 306 of the rail segment may be shorter than the length between the pivotal shaft 14 and the remote end 308 so that the rail segment 12 adopts an upwardly-slanted posture in which its forward end 306 projects into passageway 5. When an article 11 is loaded on the rail segment 12 as shown in FIG. 2B, on the other hand, the surface of the rail segment 12 adopts a downwardly slanted posture along passageway 5 due to the weight of the article itself on the rail surface.

In the following, explanations with reference to FIG. 3 will be given of the mode of operation of a "see-saw" type auxiliary rail segment 12 from its unloaded state in FIG. 2A to its loaded state in FIG. 2B. When an article 11 inserted into the top inlet port 6 rolls down a curved rail segment 2, it hits the surface of the associated rail segment 12 in its stand-by position shown in FIG. 2A, and is received thereon immediately after its passage on and along the curved rail segment 2. Subsequently, the rail segment 12 tilts about the pivotal shaft 14 like a see-saw in the direction of arrow B due to the weight of the article 11 when the article drops on the rail surface, thereby causing the rail segment 12 to change its posture to a downwardly slanted one as shown in in dotted lines in FIG. 3. As a result, Article 11 rolls on and along the surface of the rail segment 12 by gravity and moves further downward in passageway 5 along the next curved rail segment 2, and the next auxiliary rail segment 12. The same operations are thus repeated in sequence until the article ultimately reaches the end of the passageway 5. In hitting a "see-saw" type rail segment 12, the article 11 causes it to tilt and the kinetic energy which article 11 acquires as it drops is spent in pivoting the rail segment 12, thus significantly decreasing the dropping speed of the article. In this case, by appropriately setting the angle of inclination and the pivotal shaft position of the "see-saw" type rail segment 12 in its stand-by position, it is possible to reduce the dropping speed of the article to nearly zero, on the one hand and, on the other hand, to cause the article to start dropping again from the rail segment 12 due to the article's own dead weight. In this way, the rolling and dropping speed of articles 11 can be minimized over the entire unfilled length of the passageway 5, thereby sufficiently reducing the impact force of an article being loaded to effectively prevent breakage of bottle containers, abnormal foaming of the carbonated beverage in the bottle, and further disarraying its rolling posture. Incidentally, it should be noted that the shorter the pitch of auxiliary rail segments 12 in the passageway 5, the greater the speed-reducing effect upon the article. While it is best to alternately set up the curved rail segments 2 and the auxiliary rail segments 12 as shown in FIG. 2A (or 2B), it is also possible to eliminate some of the rail segments 12 without any practical inconvenience.

Figure 3:
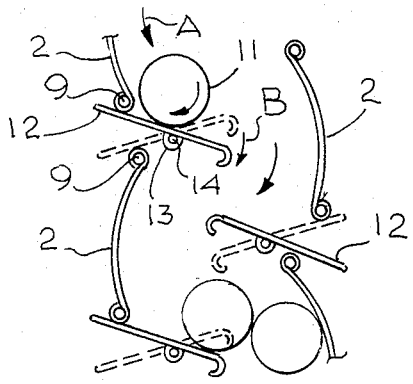
FIG. 3 is a schematic diagram of one embodiment of the auxiliary rail supporting and limiting structure according to this invention.
Figure 4:
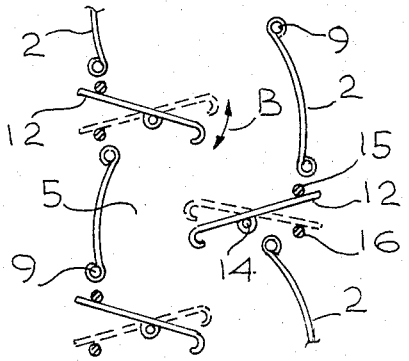
FIG. 4 is a schematic diagram of a variation of the structure of FIG. 3.
Figure 5:
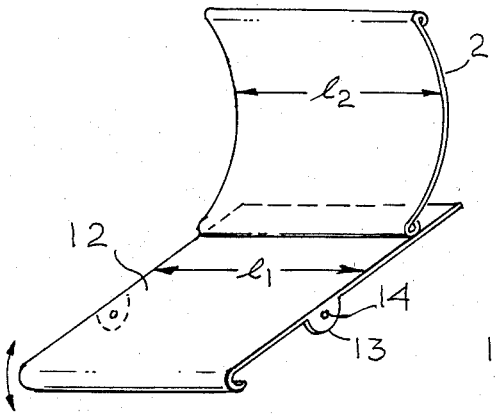
FIG. 5 is a perspective view of one form of a pivotable rail segment, according to this invention.
Figure 6:
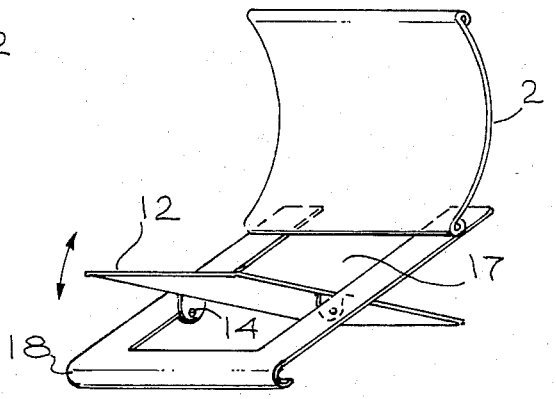
FIG. 6 is a perspective view of an alternative form of a pivotable rail segment.

In FIG. 3, fixed pins 9 of the curved rail segments 2 are utilized as stoppers for rail segments 12 to restrict the pivoting or tilting angle of rail segments 12. It is also possible for stopper pins 15, 16 to be provided separately from the curved rail segments 2, as shown in FIG. 4, to restrict the angle of tilt between the dotted line position and the solid line position of each rail segment 12. It may be further feasible for the rail segment 12 to be constructed as shown in FIG. 5 in which its width $1_1$ is the same as the width $1_2$ of the curved rail segment 2 and in conformity with the width of the passageway 5 so as to be pivotally supported on the side plates of the commodity rack (not shown). The rail segment 12 may also be constructed so as to be tiltably supported on a sloped, rectilinear fixed rail frame 18 formed by cutting out a window 17 as shown in FIG. 6. In the latter case, it is preferable for the "see-saw" type rail segment 12 to be constructed with as broad a width as possible from the aspect of assuring posture control of the articles.

There follows a description of several additional preferred embodiments of the "see-saw" type rail segment 12.

Figure 7A:
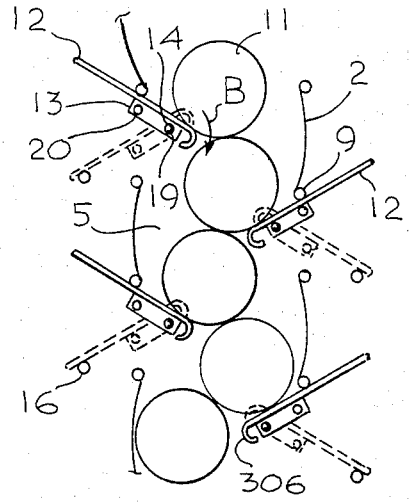
FIGS. 7A and 7B are schematic diagrams of adjustable-pivot rail segments with the pivots shown in two respective positions.
Figure 7B:
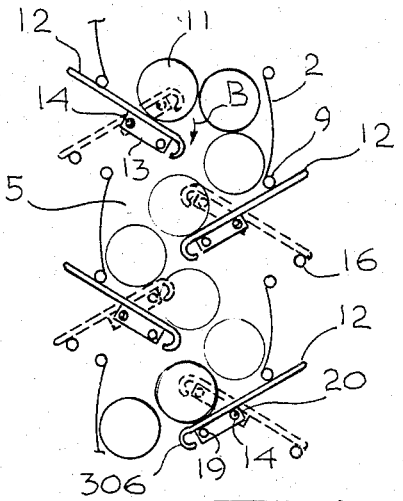

The embodiment shown in FIGS. 7A and 7B has a pivotal shaft position adjusting mechanism, in which a plurality of pin holes 19, 20 are perforated in the hinge arm 13 of the rail segment 12 with their positions of perforation being mutually different, and any one of these pin holes 19, 20 may be selected for the insertion of rotational pin 14. By providing such a pivotal shaft position adjusting mechanism, it is possible to vary the length of projection of the rail segment 12 into passageway 5, i.e. to vary the effective width of the passageway defined between the forward end 306 of a rail segment 12 and the curved rail segment opposite to such end the rail segments being adaptable to articles of varying sizes. In more detail, when articles of large diameter as shown in FIG. 7A are to be stored in the commodity rack, rotational pin 14 is selected to fit into pin hole 19, thereby rendering the effective passage width broad. On the contrary, when articles of a small diameter are handled, the pin hole 20 is chosen as in FIG. 7B, thereby increasing the projecting length of the rail segment 12 to narrow the effective passage width. Thus, the size of passageway 5 can be appropriately established in accordance with the size of the articles 11.

Figure 8:
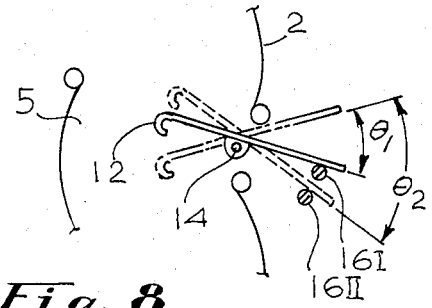
FIG. 8 is a schematic diagram of an additional rail segment support and motion-limiting embodiment.

The embodiment shown in FIG. 8 provides an adjustable stopper or limit mechanism for variably adjusting the angle of inclination of the surface of the rail segments 12 in their stand-by position. This mechanism is so constructed that the fitting position of a stopper or limit pin 16 for the associated rail segment 12 may be selectively changed to a plurality of positions 16I and 16II; the angles of inclination $\theta_1$ and $\theta_2$ of a rail segment 12 in the stand-by position may be variably adjusted as shown by the solid line and dotted line positions. In such a construction, when the angles of inclination of a rail segment 12 in stand-by position is increased, the consumption of kinetic energy of the rolling and dropping articles required to turn the rail segment 12 in the "see-saw" movement also increases. Conversely, when the angle of inclination is selected to be small, the dissipation of kinetic energy becomes accordingly small. Therefore, by appropriately selecting the position of the stopper or limit pin based on the weight of articles 11, the dropping speed can be properly controlled.

Figure 9:
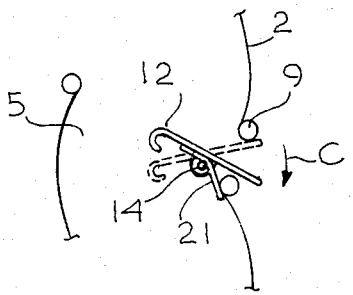
FIG. 9 is a schematic side view of an additional embodiment of this invention.

FIG. 9 shows an embodiment of a "see-saw" type rail segment 12 provided with a spring 21 to urge the rail segment into its stand-by position as indicated by arrow C. In the afore-described embodiments, rail segments 12 are inclined in their unloaded stand-by position due to balance about the pivotal point. By providing the spring 21, however, it is possible to forcibly urge the rail segment 12 from its dashed-line position into its solid line stand-by position. Moreover, since the speed-controlling force imparted to the dropping articles is varied by appropriately selecting the force of the spring 21, the dropping speed of the article becomes controllable. Incidentally, it should be noted that, besides a coil spring 21 coaxially provided on the rotational pin 14 as shown in FIG. 9, the spring 21 may also be a compression spring, tension spring, or the like, interposed between rail segment 12 and a fixed member.

Figure 10A:
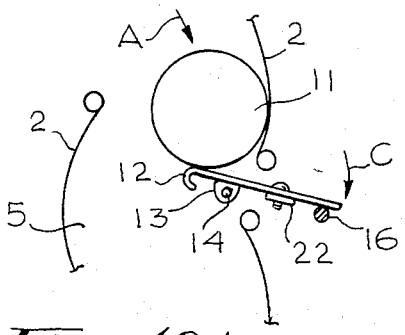
FIGS. 10A and 10B are schematic diagrams of an alternative form of rail segment for use in this invention.
Figure 10B:
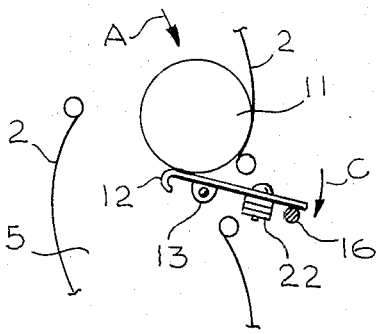

FIGS. 10A and 10B illustrate an embodiment in which a counterweight 22 is provided in place of a spring to urge rail segment 12 into its stand-by position as indicated by an arrow C. If in this case the counterweight 22 is designed to have its weight adapted to the weight of the articles to be stacked in the commodity rack, as in FIGS. 10A and 10B, the counterweight will be able to impart an appropriate speed-reducing effect to the rolling articles. This means the counterweight may be adjusted to be light for light-weight goods as shown in FIG. 10A, while a heavy setting is chosen by increasing the number of weights to control heavy-weight goods as shown in FIG. 10B.

Figure 11:
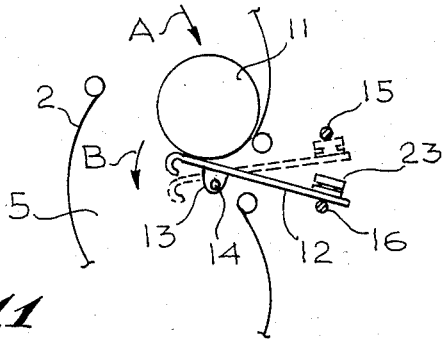
FIG. 11 is a schematic diagram of a variation of the rail segment of FIG. 10B.

The embodiment of a "see-saw" type rail segment 12 shown in FIG. 11 has a stopper/buffer member 23 made of a rubber piece provided to engage the stopper pin 15. In more detail, as article 11 drops and hits rail segment 12, causing it to turn, rail segment 12 hits stopper pin 15 with a force which may be large. The reaction from the shock of such impact is transmitted to the article 11 to appreciably disturb its normal rolling posture when the article separates from rail segment 12. However, by providing the buffer member 23 the aforementioned shock of impact can be diminished, and the article 11 can be advanced smoothly without disturbing its moving posture. This buffer member 23 may, of course, be provided on the stopper or limit pin on the opposite side, and suitable shock-absorbing materials other than rubber may be used for it.

Figure 12A:
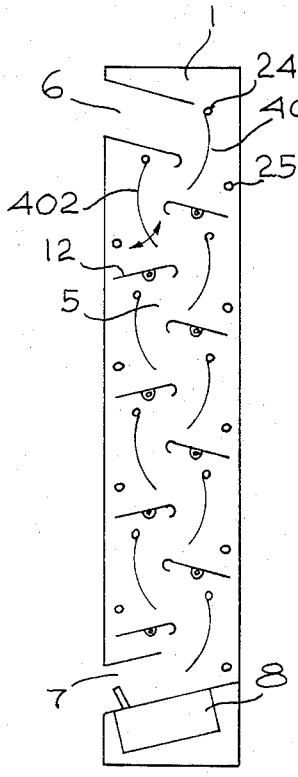
FIGS. 12A and 12B are schematic representations of an additional rail segment structure for use in this invention, 12A showing the unloaded state and 12B showing the loaded state.
Figure 12B:
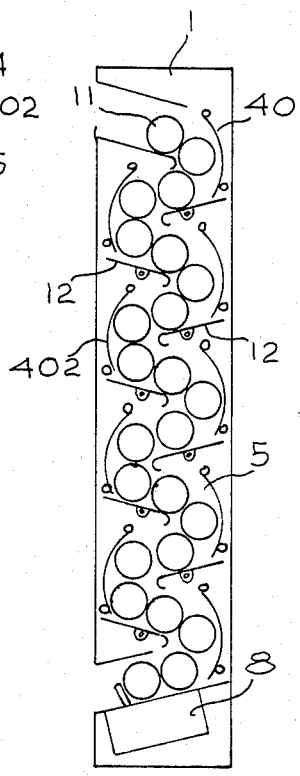

FIGS. 12A and 12B illustrate an embodiment of the "see-saw" type rail segment 12 which provides a much higher speed-reducing effect by combining a "see-saw" type rail segment 12 and a suspension-type tiltable rail segment 402 with a curved surface. In this embodiment, in addition to providing the tiltable rail segment 12, the curved rail segment 402 is not fixed on the side wall of the commodity rack as in the previous embodiments, but is pivotally supported at its top edge on a pin 24 so that it is suspended from the pin in a freely pivotable manner. Reference numeral 25 designates a stopper pin provided behind rail segment 402 for regulating its pivoting range. With this construction, the rail segment 402 is free in its stand-by state, and the rail segment 402 hangs in a direction to narrow the passageway 5, as shown in FIG. 12A, due to the location of its center of gravity and its curvature. In this state, when the articles are thrown into the commodity rack through inlet 6, the articles first hit the surface of the curved rail segment 2 and drop downward pushing the rail segment 402 sideways to enlarge the passageway 5. In so doing, the articles are subject to speed control action and part of the energy of their dropping motion is spent in pushing the curved rail segment 402 sideways, thereby reducing its dropping rate. Subsequently, the articles further reduce their speed in the same manner as mentioned above as they pass the "see-saw" type rail segment 12. It is thus possible to more effectively reduce the dropping rate of an article during the loading of the commodity rack.

FIG. 12B indicates the state of the articles when stacked in the commodity rack, where the curved rail segments 402 are pivoted backward to contact their respective stopper or limit pins 25.

Figure 13A:
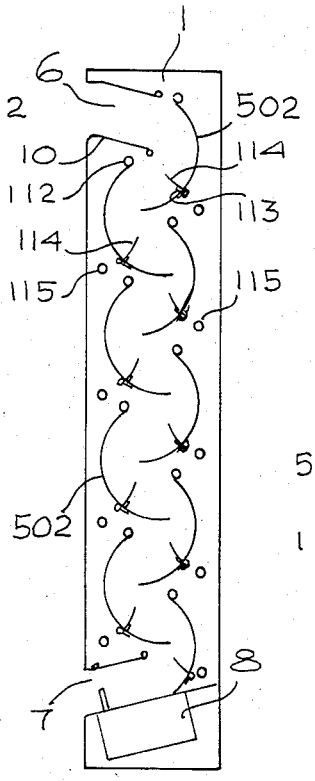
FIGS. 13A and 13B are schematic side views of an additional embodiment of this invention, 13A being unloaded and 13B loaded.
Figure 13B:
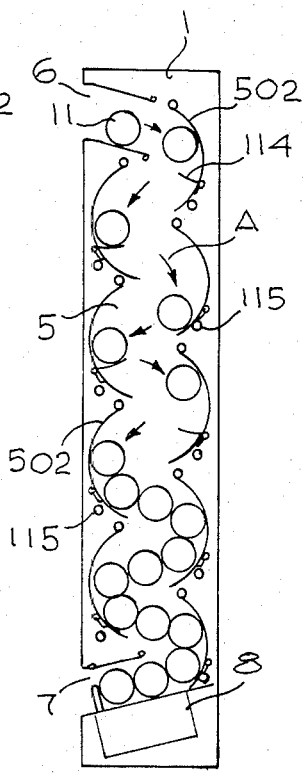
Figure 14:
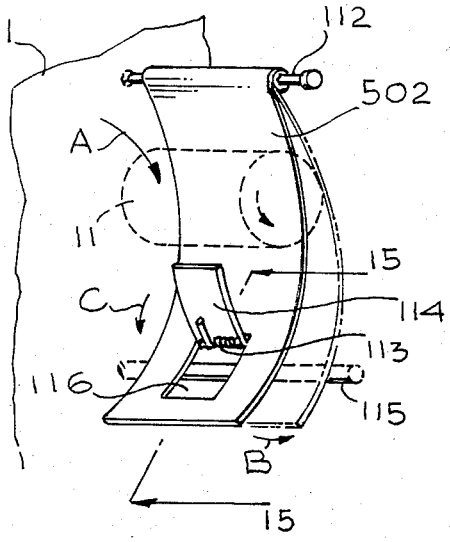
FIG. 14 is a perspective view of the rail segment of FIG. 13.
Figure 15:
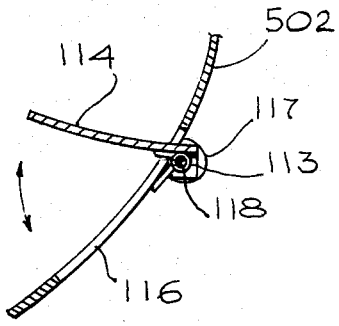
FIG. 15 is a cross-sectional side view of the rail segment of FIG. 14 viewed along lines P–Q therein.

FIGS. 13A and 13B illustrate the basic construction of a different embodiment of the commodity rack according to the present invention. Each of the curved rail segments 502 constituting the guide rails 3, 4 is not fixed to the side plate 1 of the commodity rack, but is hooked at its upper edge to a support shaft 112 to be pivotally suspended in the rack. Furthermore, the curved rail segments 502 are provided with a pivotal speed control flap or movable damping flap 114 which is so biased by a spring 113 that it normally protrudes toward the passageway 5 from the rail surface of the rail segment 502. A stopper pin 115 is fitted on the side plate 1 for the commodity rack at the back of this curved rail segment 502 to restrict the pivotal range of rail segment 502. One example of the actual construction of such rail segment is shown in FIGS. 14 and 15. In more detail, the flap 114 is fitted in a window 116 formed in the center of rail segment 502, pivotally supported on a support shaft 118 mounted on rail segment 502, and further pushed upward by the biasing coil spring 113. The force of this spring 113 is selected so that it usually urges flap 114 upward, but allows the flap to turn downwardly to retreat in window 116 under the weight of an article 11 moving over flap 114.

Figure 16A:
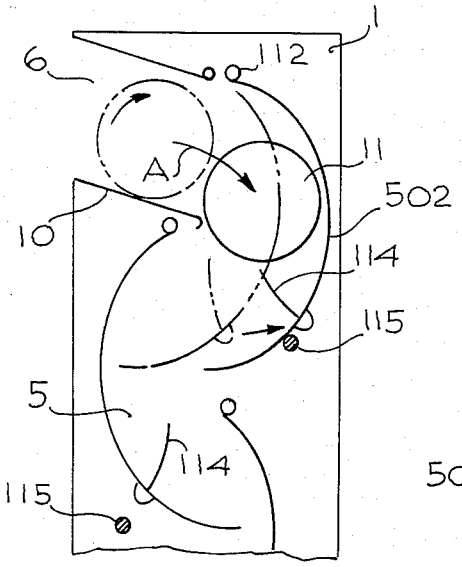
FIGS. 16A and 16B are schematic views for explaining the mode of operation of this invention.
Figure 16B:
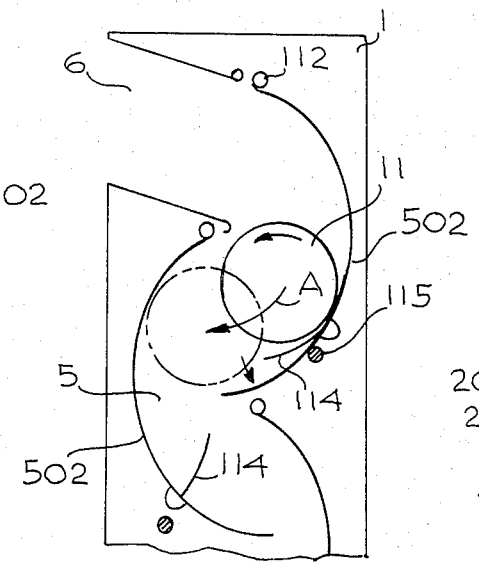

According to this construction of the commodity rack in a stand-by state when it is empty, each of the curved rail segments 502 is suspended in a manner such that its own dead weight causes it to swing closer to the adjacent rail segment of the opposite guide rail. Moreover, the speed control flap 114 of each rail segment 502 protrudes into passageway 5 by the force of spring 113. In this state of the curved rail segment 502, when articles 11 are introduced into the commodity rack through inlet 6 to replenish the goods, an article 11, which has rolled down along the top tray 10, hits the topmost rail segment 502 in the back row, while rolling from the chain line position to the solid line position in FIG. 16A, and pushes the rail segment 502 sideways from the chain line position to the solid line position to widen the passageway 5. Accordingly, part of the kinetic energy of article 11 is spent in pushing the suspended rail segment 502 sideways, thereby restricting the dropping rate of the article. As the roll movement advances along the rail surface of the rail segment 502, the article 11 collides with the flap 114 shown in FIG. 16B. After the flap 114 has been pushed back against the force of spring 113 towards its retracted position shown by arrow C to widen the passageway, the article 11 rides over the flap 114 and moves from the solid to the broken line position. While passing over this flap, the article 11 is checked in its movement due to the resistive force exerted by flap 114. Subsequently, when article 11 reaches the rail segment 502 in the front row, it experiences the checking action as mentioned above as it passes rail segment 502 and flap 114 while pushing the latter sideways to widen the commodity passageway 5. Article 11, which rolls down, drops in and passes along the passageway at the time articles are supplied to the commodity rack, is thus subjected to said checking action every time it passes by a rail segment 502 thereby considerably reducing the dropping rate of the article through the entire span of the passageway compared to a case where it rolls freely and drops without any checking action being imparted to it. When articles are accommodated in the commodity rack, the rail segment 502 is pushed sideways to a position where it contacts the stopper pin 115 at the rear owing to the dead weight of the article. In addition, the flap 114 is also retracted to a position parallel to the surface of the rail segment 502, thereby releasing an article in response to a vending instruction.

Incidentally, the illustrated embodiment is designed such that the curved rail segments 502 constituting the guide rails are all suspended on their respective pivotal shafts in a pivotable manner, and the speed checking flap is also provided on each rail segment. However, provided there is no practical inconvenience, the fixed type rail segment may also be employed in one part of the guide rails in combination with the pivotable rail segments. Furthermore, window 116 of the rail segment 502 in FIG. 14 does not necessarily have to be provided if the flap 114 is made of a sufficiently thin plate and does not hamper the guiding action of the rolling article 11.

There follows a description of a starwheel-type vending mechanism suitable for the serpentine-type commodity rack according to the present invention.

Figure 17:
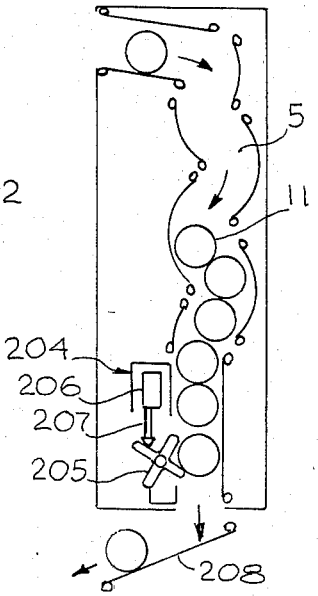
FIG. 17 is a schematic structural diagram of the overall serpentine-type of commodity rack incorporating a starwheel-type vending mechanism.

Referring to FIG. 17, the serpentine-type commodity rack incorporating the above-mentioned starwheel-type vending mechanism may be described as follows. In FIG. 17, articles 11 have their axes laid horiziontally and are accommodated in a queue within the tortuous passageway 5 formed vertically in the commodity rack. The starwheel-type vending mechanism 204 is provided at the bottom of the passageway 5, from which the articles are discharged one by one. The vending mechanism is constructed with a starwheel 205 having a plurality of arms, and projecting into the passageway 5 in a freely rotatable manner. The operation of solenoid 206 is controlled by vending instructions from remote push-buttons, for example, and a link mechanism 207 is also provided which controls the engagement and disengagement of the starwheel 205 with an article as a result of the action of the solenoid 206. In its stand-by state prior to vending, the bottommost article in the passageway 5 is engaged by the starwheel 205, thus all articles are held in the commodity rack. When a vending instruction is given, the starwheel 204 disengages the bottom-most article by the action of the solenoid 206, and the released article 11 rolls down toward a discharge chute 208 due to its own dead weight and is sent to a discharge outlet (not shown in the drawing). After the article has been discharged, the starwheel 205 is rotated. However, due to the return motion of the solenoid, the starwheel ceases to rotate further but is again locked. As soon as the next article and onward ones have moved within the commodity rack by the diameter of one article, the article is engaged and held by an arm of the starwheel. Since such starwheel-type commodity discharge devices can utilize in their driving parts an electromagnetic solenoid which is cheaper, more durable and more reliable than an electric motor they have been most widely adopted in the automatic vending machines for selling canned and bottled articles.

This vending mechanism must function to be not only capable of accurately controlling the discharge of the articles one at a time, but also capable of gentle and careful handling of the article to prevent breakage and damage. In particular, due to diversification in the types and kinds of articles, not only those in metal containers, but also those in vitreous containers such as glass bottles have been sold from automatic vending machines. Under such circumstances, this function of gentle handling or the articles in the vending mechanism tends to gain in importance.

In this connection the conventional starwheel-type vending mechanism is designed such that the starwheel is rotated continuously forward at every vending operation, from its start to its finish, causing one article to be dropped from its engaged position under its own dead weight until it is properly removed from the vending mechanism. Accordingly, each of the articles remaining in the passageway drops freely at every vending operation, for a distance corresponding to the diameter of one article, moves in the passageway, and is again engaged with, and stopped by, the starwheel. Moreover, in view of a possible collision between an article and the starwheel as well as between adjacent articles due to movement of these articles along the passageway, a bottle container would be probably broken by the collision, thus posing a great problem in the starweel-type vending mechanisms.

The present invention aims at providing a starwheel-type vending mechanism which is free of the aforementioned problem and also embodies the function of gentle handling of articles, thereby making it possible to handle with safety even articles in fragile containers such as glass bottles.

In the starwheel-type vending mechanism according to the present invention, an intermittent advancing action control mechanism is provided which couples the starwheel with the solenoid and intermittently performs the rotational advancing action of the starwheel required to discharge one article at a time by dividing such rotational advancing action, as a whole, into a plurality of separate forwarding motions.

Figure 18:
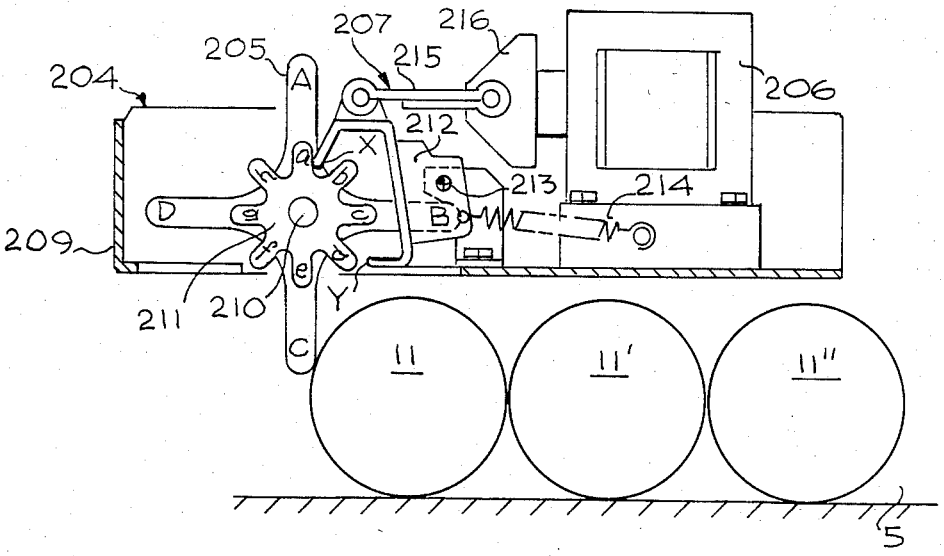
FIG. 18 is a side elevational view of one embodiment of a vending mechanism for vending an article in the commodity rack of this invention.

Referring to FIG. 18 which shows the structure of the vending mechanism, starwheel 205 has four arms A, B, C and D adapted to rotate through an angle of 90 degrees while dispensing a single article. This starwheel is rotatably supported on a shaft 210 mounted on a base member 209. Ratchet wheel 211 with teeth a to h is coaxially mounted on the same shaft 210 to which starwheel 205 is connected. In the illustrated embodiment, the number of teeth in ratchet wheel 211 is selected to be eight, an integral multiple of the number of the arms of the starwheel 205, i.e., four. A bifurcated pivotal link 212 with two pawls X, Y is mounted on a pin 213 to be freely pivotal and mesh with the teeth of ratchet wheel 211. This link 212 is constantly urged in a counterclockwise direction by a tension spring 214 on the one hand, and, on the other hand, is connected to an armature 216 of solenoid 206 via a connecting rod 215. When no electric current is flowing through solenoid 206, pawl X of link 212 meshes with ratchet wheel 211 due to the bias of the spring 214, thereby inhibiting the clockwise rotation of the ratchet wheel 211. On the contrary, when electric current flows through solenoid 206, link 212 pivots in the clockwise direction against the force of spring 214 due to the attraction of armature 216. Pawl X is retracted, and pawl Y projects toward ratchet wheel 211 to inhibit rotation of the same. Subsequently, when the solenoid executes its return motion when the current is cut off, pawl Y of the bifurcated pivotal link 212 retracts and pawl X projects. By this reciprocating operation of the solenoid, ratchet wheel 211 and thus starwheel 205 is permitted to rotate clockwise for one pitch of the teeth of ratchet wheel 211. The explanation of the construction of the starwheel-type vending mechanism according to this invention will be finished at this point and further explanations of the article dispensing control operations will be given with reference to FIGS. 18 to 21.

Figure 19:
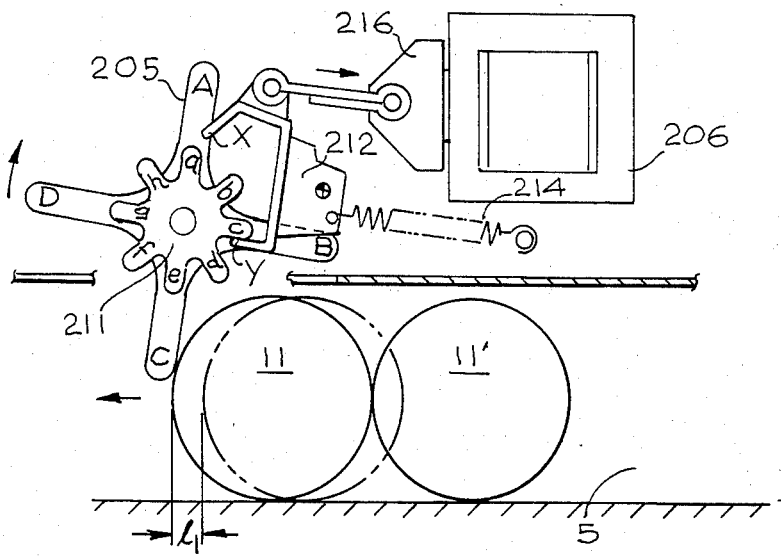
FIGS. 19 through 21 show, in schematic form, an article releasing mechanism which differs from that shown in FIG. 2; and, FIG. 22 is a timing chart for the article releasing operation of the starwheel device of FIGS. 17–21.
Figure 20:
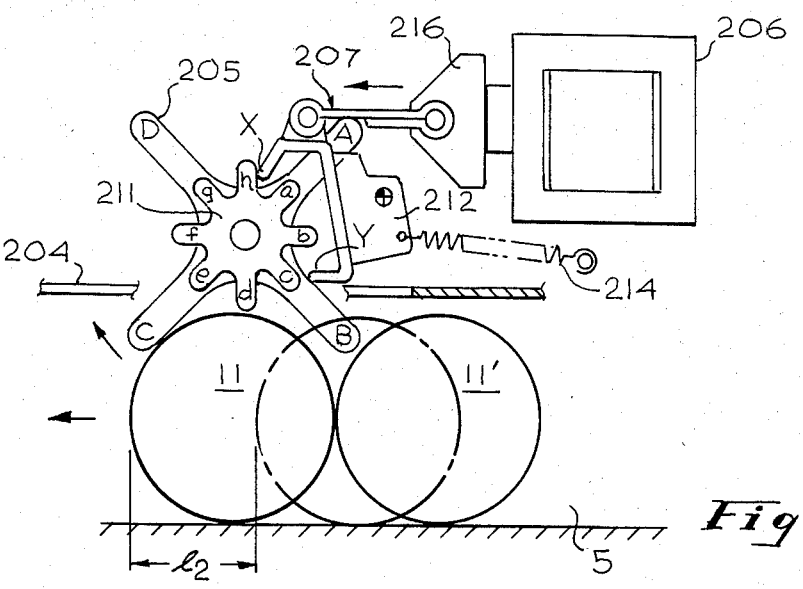
Figure 21:
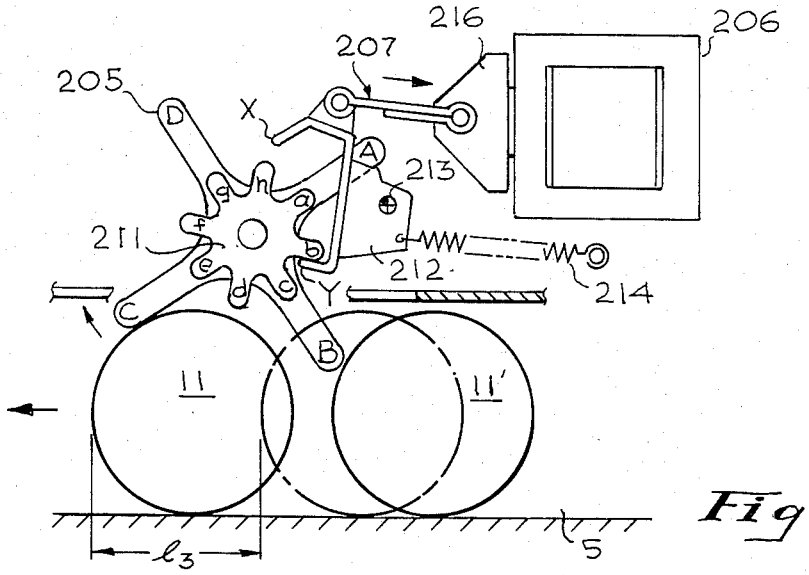

FIG. 18 indicates a stand-by state for vending articles, in which tooth a of the ratchet wheel 211 meshes with pawl X of bifurcated pivotal link 212. In this engaged position, articles 11, 11' and 11'' queued up in the passageway 5 are engaged and held in their respective positions by arm C of starwheel 205. When solenoid 206 is energized by electric current, link 212 turns clockwise as shown in FIG. 19, during which movement the starwheel 205 is rolled slightly forward in the clockwise direction until tooth c of the ratchet wheel 211 contacts pawl Y of link 212. Accordingly, the bottom-most article 11 moves in the passageway 5 by an amount $\mathbf{1}_1$, from its stand-by position shown by a chain line to its solid line position. When the solenoid is then de-energized, ratchet wheel 211 is rotated forward for substantially one pitch of the ratchet teeth until tooth h of the ratchet wheel 211 contacts pawl X of the bifurcated pivotal link 212, and the total amount of movement of article 11 is $\mathbf{1}_2$. In this state, arm B of the starwheel 205 protrudes into passageway 5 and intervenes in a space between the bottommost article 11 and the next article 11'. When the solenoid is now re-energized article 11 moves to its solid line position as shown in FIG. 21 and the total amount of movement of article 11 is $\mathbf{1}_3$. In this state, the bottommost article 11 is almost disengaged from arm C of the starwheel 205, and the second and subsequent articles are engaged and held in position by arm B of the starwheel 205 to be perfectly separated from bottommost article 11. In the ultimate operating step, when the current in the solenoid 206 is cut off again, article 11 becomes completely free, drops by reason of its own dead weight, and can be removed. At the same time, arm B of the starwheel 205 is rolled forward to the position of arm C in FIG. 18, at which point arm B is stopped by its engagement with ratchet wheel 211 and the bifurcated pivotal link 212 to retain the second and subsequent articles in their stand-by vending position. Hence, one vending operation terminates and one article is dispensed.

Figure 22:
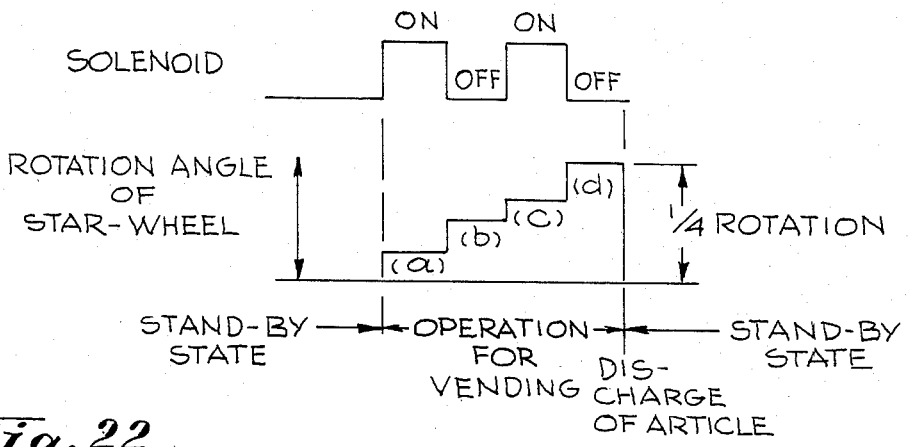

The above-described article dispensing action can be expressed in the form of a time shart as shown in FIG. 22. The solenoid 206 repeats its on-and-off operations twice on the basis of the vending instructions at every vending operation. Such electric current conduction control can be effected by an appropriate vending control circuit. This current conduction control intermittently moves starwheel 205 through an intermittent advancing action control mechanism comprising a separate ratchet wheel 211 and bifurcated pivotal link 212 in such a manner that the rolling and forwarding movement required to dispense a single article may be divided into four operating steps. Since the amount of dropping and movement of the article in the commodity rack in each of four separate operating steps for advancing the article is less than the total amount of movement during one vending operation, the drop-moving rate of the article can be kept lower for that separate advancing action. Accordingly, the force of impact between the article and the starwheel as well as the impact caused by collision of adjacent articles can be reduced considerably compared to conventional devices. Thus, the function of moderate article handling which is the object of the present invention can be realized by a driving system using a solenoid, thus making it possible to reliably handle with care articles in fragile containers such as glass bottles.

Although the illustrated embodiment shows the starwheel and ratchet wheel arranged coaxially in direct connection, it should be noted that they can be connected via a gear mechanism, for example. By constructing the vending mechanism in this way, the number of teeth on the separate advancing ratchet wheel can be selected within a wide range. Furthermore, the illustrated embodiment shows an example of dividing the vending operations into four stages of separate advancing actions a to d as shown in FIG. 22, and the function of gentle article handling can be greatly improved if the number of divisions in the operating stages is increased further although the time required for removing the articles becomes longer.

What is claimed is:

1. For use in automatic vending machines, a commodity rack including:

first and second side walls;

front and rear walls joined to said first and second side walls to form the outer shell of said commodity rack;

said front wall having an inlet port in the upper portion thereof and an outlet port in the lower portion thereof;

a pair of vertical guide rails each comprising a series of concave rail segments, each rail segment having a pair of edges and being supported by at least one side wall and being vertically displaced with respect to each other within each guide rail and with respect to corresponding but oppositely directed concave rail segments in the other guide rail but having the respective pairs of edges on each of said pair of vertical guide rails spaced, horizontally, from said pairs of edges on said oppositely directed concave rail segments and being positioned on the opposite side of a vertical plane passing centrally through said pair of vertical guide rails, from said pairs of edges on said oppositely directed concave rail segments, thereby defining a vertically disposed, open passageway coupling said inlet port and said outlet port; and, a plurality of auxiliary rail segments each of which is pivotably supported below a respective one of said concave rail segments by way of at least one of said side walls and each of which contains biasing means which cause each auxiliary rail segment, in the unloaded state, to protrude into said passageway with an upwardly inclined attitude;

each of said auxiliary rail segments being pivotably supported along its upper edge from at least one of said first and second side walls and being pivotable to a downwardly inclined attitude in response to a weight being applied thereto.

2. For use in automatic vending machines, a commodity rack including:

first and second side walls;

front and rear walls joined to said first and second side walls to form the outer shell of said commodity rack;

said front wall having an inlet port in the upper portion thereof and an outlet port in the lower portion thereof;

a pair of vertical guide rails each comprising a series of concave rail segments, each rail segment having a pair of edges and being supported by at least one side wall and being vertically displaced with respect to each other within each guide rail and with respect to corresponding but oppositely directed concave rail segments in the other guide rail but having the respective pairs of edges on each of said pair of vertical guide rails spaced, horizontally, from said pairs of edges on said oppositely directed concave rail segments and being positioned on the opposite side of a vertical plane passing centrally through said pair of vertical guide rails, from said pairs of edges on said oppositely directed concave rail segments, thereby defining a vertically disposed, open passageway coupling said inlet port and said outlet port;

a plurality of auxiliary rail segments each of which is pivotably supported below a respective one of said concave rail segments by way of at least one of said side walls and each of which contains biasing means which cause each auxiliary rail segment, in the unloaded state, to protrude into said passageway with an upwardly inclined attitude;

each of said auxiliary rail segments being pivotably supported along its upper edge from at least one of said first and second side walls and being pivotable to a downwardly inclined attitude in response to a weight being applied thereto; and, a damping flap movably positioned in each of said concave rail segments.

* * * * *